US010323918B2

(12) United States Patent
Menefee, III

(10) Patent No.: US 10,323,918 B2
(45) Date of Patent: Jun. 18, 2019

(54) AUTO-SEGMENTING SPHERICAL PROJECTILE

(71) Applicant: POLYWAD, INC., Roberta, GA (US)

(72) Inventor: James Y. Menefee, III, Macon, GA (US)

(73) Assignee: Polywad, Inc., Macon, GA (US)

( * ) Notice: Subject to any disclaimer, the term of this patent is extended or adjusted under 35 U.S.C. 154(b) by 0 days.

(21) Appl. No.: 15/329,418

(22) PCT Filed: Jul. 25, 2015

(86) PCT No.: PCT/US2015/042227

§ 371 (c)(1),
(2) Date: Jan. 26, 2017

(87) PCT Pub. No.: WO2016/060726

PCT Pub. Date: Apr. 21, 2016

(65) Prior Publication Data

US 2017/0211918 A1 Jul. 27, 2017

Related U.S. Application Data

(60) Provisional application No. 62/030,545, filed on Jul. 29, 2014.

(51) Int. Cl.
*F42B 12/34* (2006.01)
*F42B 12/36* (2006.01)
(Continued)

(52) U.S. Cl.
CPC ..... *F42B 12/367* (2013.01); *F42B 7/046* (2013.01); *F42B 12/34* (2013.01); *F42B 33/00* (2013.01); *F42B 10/48* (2013.01)

(58) Field of Classification Search
CPC ..... F42B 6/10; F42B 7/04; F42B 7/02; F42B 7/043; F42B 7/046; F42B 8/12; F42B 8/14; F42B 12/34; F42B 12/367
See application file for complete search history.

(56) References Cited

U.S. PATENT DOCUMENTS 221,249 A * 11/1879 Nowlan ..... F42B 12/34 102/506
631,703 A * 8/1899 Dunn ..... F42B 12/34 102/494

(Continued)

FOREIGN PATENT DOCUMENTS

FR 1296780 A 6/1962
WO 96/41112 A2 12/1996

OTHER PUBLICATIONS

PCT International Search Report and Written Opinion for International Application No. PCT/US2015/042227 dated Mar. 22, 2016.

*Primary Examiner* — Derrick R Morgan

(57) ABSTRACT

Described are spherical projectiles such as used in birdshot, buckshot, or single ball spherical projectiles, including slugs, muzzle loading projectiles, or any close-to-bore diameter projectile, that is auto-segmenting or self-segmenting upon impact with a target. The projectile or shot disclosed herein retains its shape and structure during flight until impact with soft tissue, whereupon its individual sections separate or segment in a controllable manner, each portion of the projectile imparting or depositing a high amount energy to the tissue and target. The auto-segmenting spherical projectiles can be frangible or non-frangible. This disclosure also provides cartridges such as shotshells that are loaded with the projectiles described herein.

14 Claims, 4 Drawing Sheets

(51) Int. Cl.

| | |
|---|---|
| ***F42B 7/04*** | (2006.01) |
| ***F42B 33/00*** | (2006.01) |
| *F42B 10/48* | (2006.01) |

(56) References Cited

U.S. PATENT DOCUMENTS 2,377,675 A * 6/1945 Choate et al. ..... F42B 25/00 102/482
2,497,212 A * 2/1950 Donofrio ..... A61J 3/07 156/145
3,142,254 A * 7/1964 Grinzenberger ..... F42B 7/046 102/458
3,344,742 A * 10/1967 Schneider, Jr. ..... F42B 23/16 102/394
3,400,660 A * 9/1968 Malter ..... F42B 7/04 102/459
4,913,054 A * 4/1990 Petersen ..... F42B 12/34 102/439
4,938,147 A * 7/1990 Czetto, Jr. ..... F42B 12/34 102/507
4,949,645 A * 8/1990 Hayward ..... A01K 95/005 102/459
5,020,438 A * 6/1991 Brown ..... F42B 10/04 102/436
5,097,768 A * 3/1992 Petrovich ..... F42B 12/34 102/510
5,185,495 A * 2/1993 Petrovich ..... F42B 12/34 102/507
D348,915 S * 7/1994 Fraser ..... D21/707
5,446,987 A * 9/1995 Lee ..... F41C 9/085 42/61
5,480,143 A * 1/1996 McMurry ..... A63B 43/00 473/281
5,877,437 A * 3/1999 Oltrogge ..... B22F 1/0003 75/228
6,145,441 A * 11/2000 Woodall ..... F42B 8/14 102/370
6,176,186 B1 * 1/2001 Engel ..... F42B 12/34 102/506
6,209,180 B1 * 4/2001 Amick ..... F42B 7/046 102/459
6,478,822 B1 * 11/2002 Leroux ..... A61F 2/442 623/17.14
6,543,365 B1 * 4/2003 Vasel ..... F41B 11/57 102/367
7,211,007 B2 * 5/2007 Sullivan ..... A63B 37/0003 473/374
7,399,334 B1 * 7/2008 Wei ..... C22C 1/045 102/448
8,122,832 B1 * 2/2012 Wei ..... F42B 10/00 102/439
8,220,396 B2 * 7/2012 Ritt ..... F42B 12/76 102/502
8,556,747 B2 * 10/2013 Hung ..... A63B 37/0003 473/353
2002/0112640 A1 * 8/2002 Brown ..... F42B 12/36 102/513
2004/0244628 A1 * 12/2004 O'Dwyer ..... F41A 19/58 102/480
2004/0244629 A1 * 12/2004 Jopson ..... F42B 12/34 102/508
2005/0066841 A1 * 3/2005 Vasel ..... F41B 11/62 102/502
2005/0188886 A1 * 9/2005 Vasel ..... F41B 11/57 102/502
2006/0283431 A1 * 12/2006 Lee ..... F41A 9/30 124/41.1
2007/0054762 A1 * 3/2007 Tocco ..... F42B 6/10 473/577
2008/0134927 A1 * 6/2008 Skellern ..... F42B 6/00 102/368
2009/0114113 A1 * 5/2009 Poore ..... F42B 7/046 102/460
2009/0217837 A1 * 9/2009 Hwang ..... F42B 6/10 102/502
2010/0083862 A1 * 4/2010 Ciesiun ..... F42B 6/10 102/513
2011/0146133 A1 * 6/2011 Bunker ..... A01M 1/02 43/132.1
2011/0259229 A1 * 10/2011 Cameron ..... F42B 4/02 102/360
2012/0308426 A1 * 12/2012 Perez ..... B22F 3/26 419/66
2014/0230680 A1 * 8/2014 Meller ..... F42B 12/34 102/439
2014/0318403 A1 * 10/2014 Amick ..... F42B 7/046 102/459
2016/0018200 A1 * 1/2016 Sharudenko ..... F42B 5/025 102/517
2018/0156588 A1 * 6/2018 LeBlanc ..... F42B 12/34

* cited by examiner

AUTO-SEGMENTING SPHERICAL PROJECTILE

CROSS REFERENCE TO RELATED APPLICATIONS

This application is a 35 U.S.C. § 371 National stage application of International Patent Application No. PCT/US2015/042227, filed Jul. 27, 2015, which claims the benefit of U.S. Provisional Patent Application No. 62/030,545, filed Jul. 29, 2014, each of which is incorporated herein by reference in its entirety.

TECHNICAL FIELD

This disclosure relates to substantially spherical projectiles such as birdshot, buckshot, or spherical slug projectiles and shotshell cartridges that are loaded with these spherical projectiles.

BACKGROUND

Projectiles for rifle and handgun ammunition (bullets) are often designed with hollow or soft points or polymer-filled tips that allow the projectile to expand in diameter upon impact with a soft tissue target. Specific design of the projectile allows control of its expansion such that the projectile penetrates sufficiently to hit vital organs, yet is still retained by and comes to rest within the target. Bullet retention is thought to allow all its kinetic energy to be deposited within target, further enhancing its lethality. Even when the bullet does not come to rest within the target, if expansion dramatically slows the bullet, sufficient kinetic energy may be deposited to the soft tissue to also increase lethality.

While such considerations have been important to the theory and practice of bullet design, they are not readily applicable to designing spherical projectiles such as birdshot or buckshot. For example, bullets will consistently impact the target with the nose or tip hitting the target first, and bullet designs are based on this certainty. Spherical projectiles may hit the target without predictability in which leading portion of the projectile will encounter the target first. Moreover when multiple shot projectiles are loaded into shotshells, they are typically or often loaded in random orientations. Therefore, applying conventional bullet design considerations to improving spherical projectile performance becomes an insurmountable problem.

What is needed is a design that allows generally spherical projectiles such as shot to controllably expand in effective diameter when striking soft tissue. Such a design would be applicable regardless of the size of the shot, so that even large buckshot would still have a high likelihood of being retained within the soft tissue target for energy deposit.

SUMMARY OF THE INVENTION

This disclosure describes generally a spherical projectile such as used in birdshot, buckshot, or a single ball spherical projectile that is auto-segmenting or self-segmenting upon impact with a target. The projectile or shot disclosed herein retains its shape and structure during loading, firing, and during flight until impact with soft tissue, whereupon its sections separate or segment in a controllable manner, each portion of the projectile imparting or depositing a high amount of energy to the tissue and target. This disclosure also provides cartridges such as shotshells that are loaded with the projectiles or shot described herein.

According to an aspect, this disclosure provides an auto-segmenting spherical projectile, the projectile comprising:

a) at least 2 segments comprising a frangible material or a non-frangible material;

b) at least one connecting element that contacts each segments and separably connects the segments into a sphere.

Generally, the auto-segmenting spherical projectile can comprise from 2 to 12. Also generally, the segments can be substantially identically sized and/or substantially identically shaped. The connecting element can be at the center of the spherical projectile or off-center, and the segments can be identically-shaped or non-identically-shaped. Further, the auto-segmenting spherical projectile of this disclosure can be or can comprise birdshot, buckshot, or spherical slugs. Particularly useful are the auto-segmenting spherical projectiles that comprise two perpendicular grooves defining the segments, two parallel grooves defining the segments, or four grooves in two perpendicular sets on opposite sides of the sphere, defining the segments.

According to a further aspect, this disclosure provides a method of making an auto-segmenting spherical projectile, the method comprising:

a) providing a powder comprising at least one metal;

b) providing a spherical powder metallurgy mold having one or more internal ridges projecting toward the center of the sphere; and c) compacting the powder in the spherical mold to form an auto-segmenting spherical projectile having one or more troughs corresponding to the one or more internal ridges which define segments of the projectile.

Generally, the spherical powder metallurgy mold can have two or more internal ridges projecting toward the center of the sphere, and the auto-segmenting spherical projectile can therefore have two or more troughs corresponding to the two or more internal ridges which define segments of the projectile.

The disclosed method of making an auto-segmenting spherical projectile can be, for example, a cold compacting method or it can include at least one heating step such as annealing or sintering. The auto-segmenting spherical projectile can be frangible or non-frangible. For example, the projectile can comprise lead or be lead-containing, or it can be lead-free. The process is particularly useful for making non-toxic, frangible or non-frangible projectiles such as auto-segmenting spherical projectiles that can comprises steel, bismuth, tungsten, tin, iron, copper, zinc, aluminum, nickel, chromium, molybdenum, cobalt, manganese, antimony, alloys thereof, or composites thereof.

A further aspect of this disclosure provides for shotshell cartridges that comprise at least one auto-segmenting spherical projectile according to the disclosure, or made according to the disclosed methods, or both. These and other aspects, embodiments, and features of this disclosure are discussed in detail below, and reference is made to the figures.

BRIEF DESCRIPTION OF THE DRAWINGS

FIGS. 1A, 1B, and 1C are different elevation views along each of the x, y, and z axes, and FIG. 1D is a perspective view.

FIGS. 2A, 2B, and 2C are different elevation views along each of the x, y, and z axes, and FIG. 2D is a perspective view. In FIG. 2C, the thickness of the connecting element is less than the distance from the circular edge of each hemispherical segment to the connecting element. FIG. 2E is an elevation view similar to that of FIG. 2C, in which the thickness of the connecting element is greater than the distance from the circular edge of each hemispherical segment to the connecting element.

FIGS. 3A, 3B, and 3C are different elevation views along each of the x, y, and z axes, and FIG. 3D is a perspective view.

DETAILED DESCRIPTION OF THE INVENTION

Figure 1A:
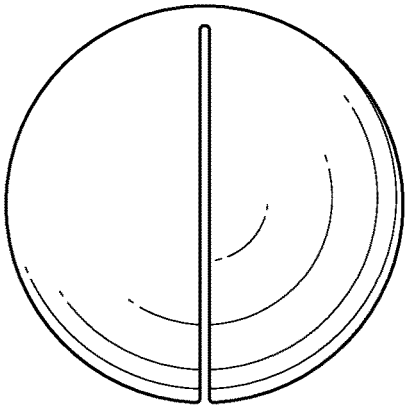
FIGS. 1A-1D illustrate different views of an embodiment according to this disclosure, namely, a hinged or "clamshell" auto-segmenting spherical projectile.
Figure 1B:
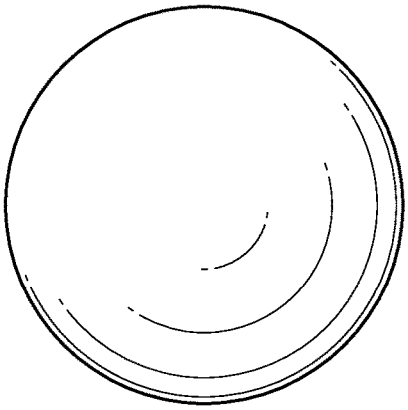
Figure 1C:
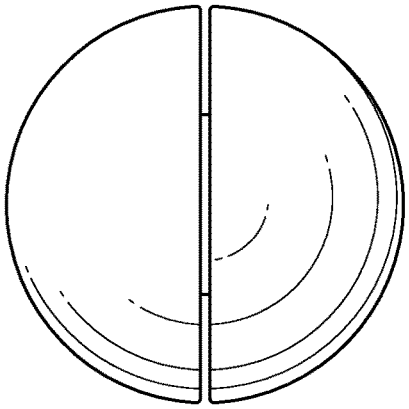
Figure 1D:
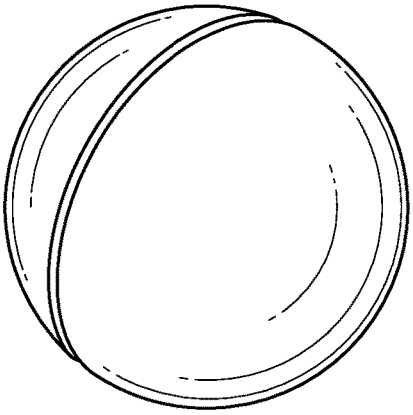
Figure 2A:
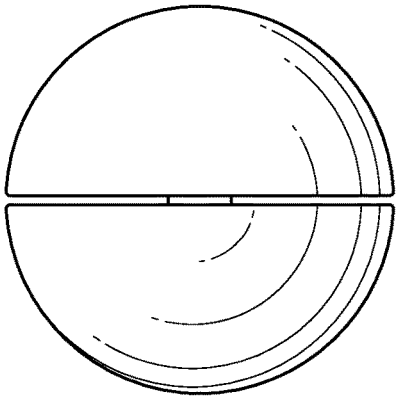
FIGS. 2A-2E illustrate different views of an embodiment according to this disclosure, namely, a 2-slotted auto-segmenting spherical projectile.
Figure 2B:
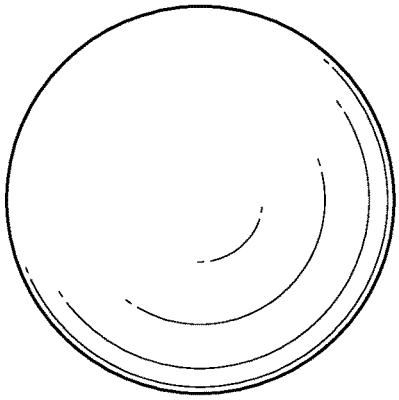
Figure 2C:
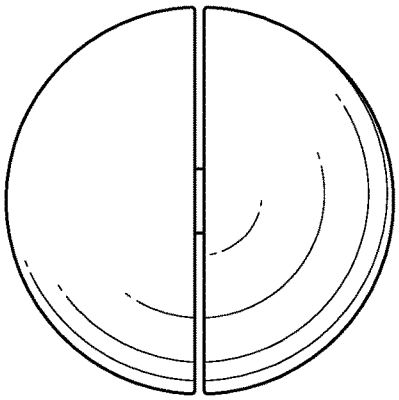
Figure 2D:
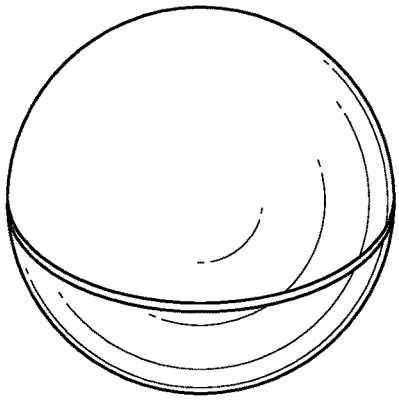
Figure 2E:
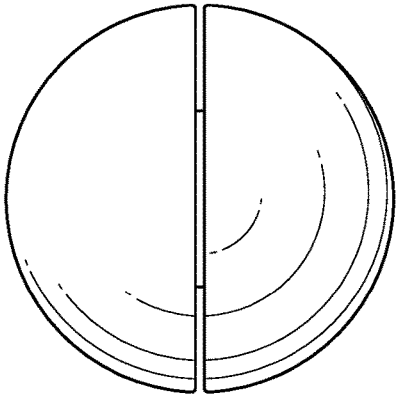
Figure 3A:
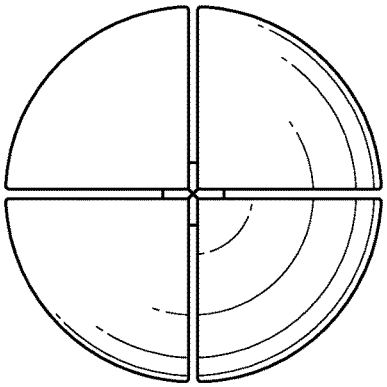
FIGS. 3A-3D illustrate different views of an embodiment according to this disclosure, namely, a 4-slotted auto-segmenting spherical projectile.
Figure 3B:
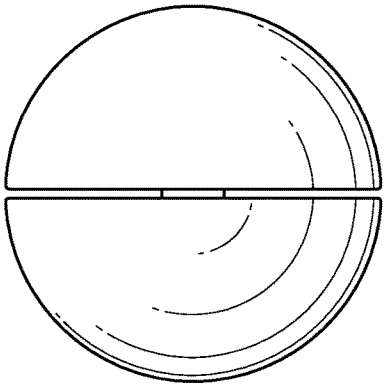
Figure 3C:
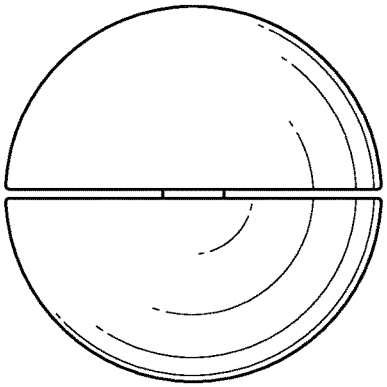
Figure 3D:
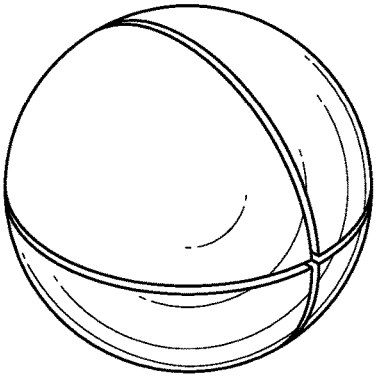

This disclosure describes generally a spherical projectile such as used in birdshot, buckshot, or a single ball spherical projectile, including a slug or muzzle loading projectile or close-to-bore diameter projectile, that is auto-segmenting or self-segmenting upon impact with a target. The projectile or shot disclosed herein retains its shape and structure during loading, firing, and during flight until impact with soft tissue, whereupon its sections separate or segment in a controllable manner, each portion of the projectile imparting or depositing a high amount energy to the tissue and target. It has been unexpectedly found that projectiles can be fabricated that auto-segmenting in a controlled and predictable fashion upon impact with a desired target, regardless of the projectile's orientation with respect to the target.

According to one aspect, the auto-segmenting projectiles of this disclosure can comprise non-frangible segments, such that they auto-segment upon impacting a soft tissue or other target, but otherwise do not generally break apart. In a further aspect, the auto-segmenting projectiles can comprise frangible segments, such they auto-segment upon impacting soft tissue, but break apart into countless irregular-shaped particles, typically resembling dust, upon striking an unyielding, hard target. The latter provides a method of increasing the lethality with respect to soft tissue and also increasing the safety with respect to reducing or substantially eliminating over-penetration of the spherical projectile. Further, the projectiles, shotshells, and methods of this disclosure are applicable to any size spherical projectile.

The term "spherical" projectile is understood by the skilled person in the art to mean "substantially spherical," and is used primarily to distinguish the disclosed projectiles from bullets designed for rifle cartridges. That is, it is recognized that the disclosed projectiles are generally useful in shotshell loadings and may include surface features that impart slight out-of-round properties to the projectile. These features may arise as an artifact of the manufacturing method (such as in a powder metallurgy or "compacted powder" method), an intentionally imparted structural feature (such as a cutting edge feature), unintentional structural feature (such as a burr), or the like. All of these features and departures from perfect spheres are recognized by the skilled person to be elements and aspects that may occur in projectiles that are generally regarded as "spherical" and are useful in shotshell loadings.

The present design does not require any particular portion of the auto-segmenting spherical projectile or shot to encounter the target first, that is, no specific leading edge of the spherical projectile is required to hit the target first to ensure auto-segmentation and separation of the sections of the projectile. As a result, the disclosed projectiles are particularly useful for birdshot, buckshot, single ball projectiles, or any similar spherical projectile in which loading and firing from a shotshell results in random orientations of the projectiles at the target. This disclosure also provides cartridges such as shotshells that are loaded with the spherical auto-segmenting projectiles or shot described herein.

Figure 4:
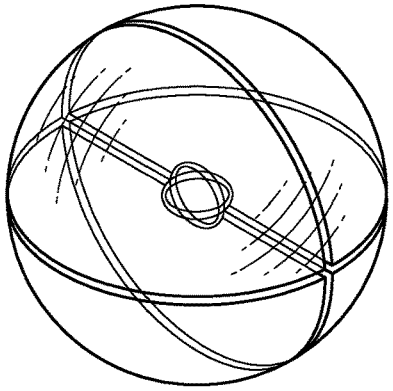
FIG. 4 illustrates a perspective view of an embodiment according to this disclosure, namely, a 4-slotted auto-segmenting spherical projectile, with the center connector illustrated.
Figure 5:
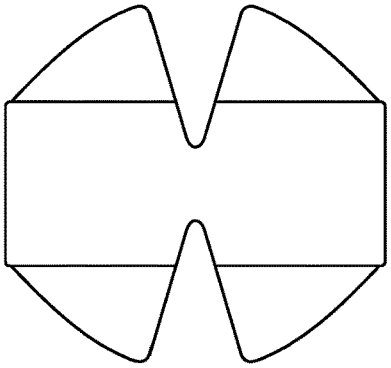
FIG. 5 illustrates an elevation view of an embodiment according to this disclosure, namely, a parallel two-slotted auto-segmenting spherical projectile, with the two slots oriented in a parallel fashion. Two-slotted auto-segmenting spherical projectiles of this type can be made by a compacted powder (powder metallurgy) method.
Figure 6:
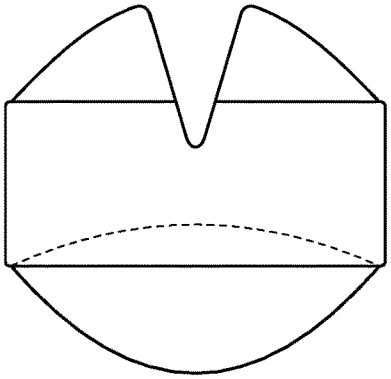
FIG. 6 illustrates an elevation view of an embodiment according to this disclosure, namely, a perpendicular two-slotted auto-segmenting spherical projectile, with the two opposing slots oriented in a perpendicular fashion. Two-slotted auto-segmenting spherical projectiles of this type can be made by a compacted powder (powder metallurgy) method.

Aspects of the present disclosure are particularly illustrated in the figures, and FIGS. 1-6 present a good comparison and illustration of how these aspects of the disclosed projectiles can vary. Generally, the space or gap between the individual segments in the figures may be exaggerated to more clearly illustrate the representative shapes and structures. The various illustrated aspects of the projectiles can vary according to the particular need. For example, the material itself can vary in composition, density, hardness and the like. The overall segment itself and the connection(s) between segments can vary in structure, size, and shape, to achieve a projectile specific to the desired velocity, the characteristics of the target, the desired ease or rate of opening and separating of the segments, and other particular design needs. In addition, the number, relative orientation, depth, and shape of the cuts (that is, troughs or channels) in a projectile such as illustrated in FIG. 5 and FIG. 6 can vary and are found to produce auto-segmenting under somewhat different conditions such as velocity and target density.

In one aspect, the segment structure in the present projectiles is different than that of previous projectiles that are characterized by being "scored" to form lines of weakness, along which the projectile will separate into petals and/or break apart upon impact. Such scoring is found, for example, in a jacketed bullet, and the scoring can be only in the jacket itself or in the jacket and into the underlying bullet as well. The present projectiles do not include merely weakened parts, but rather substantially separated portions that are joined with a connector of a specific shape, size, composition, and structure. In this aspect, the thickness of the connector can be less than or equal to the depth of the cut in the substantially spherical projectile. In some aspects, the thickness of the connector can be greater than or equal to the depth of the cut in the substantially spherical projectile. However, in either case, the projectile is designed to separate when striking a desired target.

Thus, while not intending to be bound by theory, it has been found that to achieve the auto-segmentation feature of the present design does not require any particular portion of the spherical shot to encounter the target first, and it has been found that segmented (not scored) portions of a spherical projectile work well. The planes and/or lines of "separation" in the disclosed segmented projectile contrast to the mere lines of "weakness" in a scored projectile. The weakened (scored) structure requires a large amount of energy to split the projectile along the scored lines, such energy generally being available only in rifle or pistol bullets. In contrast, because the spherical projectiles of this disclosure are already largely separated, being connected at only a portion of the contiguous area, separation is readily achieved in lower velocity projectiles as desired.

The disclosed segmented portions are capable of withstanding the rigors of manufacturing, loading, and firing and remain connected, yet can be programmed for disruption by impact with a soft tissue target. While not bound by theory, it is thought that disruption and breaking apart of the auto-segmenting projectile can occur by the hydrostatic/hydraulic pressure created by impact with a soft tissue target and/or by shearing of the connector upon impact and the uneven pressure resulting from impact upon striking soft tissue or hard surfaces, regardless of orientation. By eliminating the need to have the projectile oriented in a particular direction upon striking the target, the present design can be used as shot in shotshells or for any spherical projectile. This design greatly expands the utility of the spherical projectiles, because they can be fabricated with selected materials, varying connector thickness, and the like, to initiate disruption and breaking apart when launched at very low velocities, medium velocities, or only at high velocities, depending upon the need.

FIGS. 1A-1D illustrate different views of one aspect and embodiment according to the disclosure, namely, a hinged or "clamshell" type auto-segmenting spherical projectile. This hinged or "clamshell" auto-segmenting spherical projectile shown in FIGS. 1A-1D comprises two hemispherical sections connected by a post, hinge, or more generally, connector or connecting element, that is at or near an edge of each hemisphere's circular face. In this figure, the space or gap between the individual segments is exaggerated for clarity. In some embodiments, the cut between segments can be less than, equal to, or more than halfway through the projectile diameter. The deep or more than halfway through the projectile diameter is shown in FIGS. 1A-1D. The flat, internal surfaces or faces of the segments arising from this clamshell structure can be touching each other in some embodiments.

FIGS. 2A-2E illustrate different views of an embodiment according to this disclosure referred to as a 2-slotted auto-segmenting spherical projectile, or "2-slot" projectile. The 2-slot auto-segmenting spherical projectile also comprises a projectile having two hemispherical sections connected by a connecting element that is at or near the center of each hemisphere's circular face. The post or connector element can vary in thickness to afford different levels of stability to the spherical projectile before segmentation initiates upon striking a target.

FIGS. 3A-3D and FIG. 4 illustrate different views of an embodiment according to this disclosure referred to as a 4-slotted auto-segmenting spherical projectile, or "4-slot" projectile. The 4-slot auto-segmenting spherical projectile comprises a projectile having four quadraspherical sections connected by a connecting element or moiety that is at or near the center of each quadraspherical section's right angle edge at the inner portion of the overall sphere. Another aspect of a 4-slot design is illustrated in FIG. 4, in which a substantially spherical connector is illustrated. The post or connector element can vary in thickness to afford different levels of stability to the spherical projectile before segmentation initiates upon striking a target.

FIG. 5 illustrates another aspect of this disclosure, namely, a two-slotted auto-segmenting spherical projectile in which the two slots are oriented in a parallel fashion. A powder metallurgy method works well to fabricate two-slotted auto-segmenting spherical projectiles of this type. The depth of the cut between segments can be more than halfway through the projectile diameter as shown in this figure. Alternatively, the depth of the cut between segments can be less than or roughly equal to the projectile diameter if desired. It is noted that the angle of the cut shown in the view of FIG. 5 can vary from very small (for example, less than 5°) to fairly large (for example, up to about 45°), and any angle between. That is, the angle of the cut can be about 5°, about 10°, about 15°, about 20°, about 25°, about 30°, about 35°, about 40°, or about 45°. The circular belt around the circumference of the projectile that is shown is a typical feature that can arise in the pressed metal powder method. This compacted powdered metal method is particularly useful for making non-toxic and/or frangible pellets.

FIG. 6 illustrates another aspect of the disclosure, namely, a two-slotted auto-segmenting spherical projectile in which the two slots are oriented in a perpendicular fashion, that is, in a "criss-cross" fashion. It is noted that in this two-slotted configuration, the relative orientation of the two slots can be at any angle between parallel (as in FIG. 5) and perpendicular (as in FIG. 6). The powder metallurgy method works well to fabricate such spherical projectiles. Again, depth of the cut between segments can be more than halfway through the projectile diameter as shown in this figure, or can be less than or roughly equal to the projectile diameter if desired. The angle of the cut shown in the view of FIG. 6 also can vary from very small (for example, less than 5°) to fairly large (for example, up to about 45°), and any angle between. That is, the angle of the cut can be about 5°, about 10°, about 15°, about 20°, about 25°, about 30°, about 35°, about 40°, or about 45°.

According to a further aspect, either of the embodiments of FIG. 5 or FIG. 6 can represent the starting point for further embodiments, in which a further cut (trough) is imparted perpendicular to and across each of the cuts (troughs) shown FIG. 5 or FIG. 6. In this fashion, the auto-segmenting spherical projectile can be fabricated with eight (8) segments. By describing the projectile as formed with "cuts," it is not intended to limit the method of fabrication to one in which actual slices or cuts are made into an initially spherical starting object. Rather, this method of describing the "cuts" in the projectile is used to explain the overall structure of the projectile, regardless of how the cuts and resulting connector are fabricated. For example, the pressed or compacted powder method works well to compact powdered materials such as metals into an object of the desired shape such as shown, and this method is useful for making non-toxic and/or frangible pellets. In this method, fabricating spheres with any number and orientation of cuts can be readily understood and carried out by the person of skill in the art, and the process can be cost effective and efficient. As described, a circular belt around the circumference of the projectile that is shown in FIG. 5 and FIG. 6 is a typical feature of pressed metal powder method, and as used herein, such projectiles are described as spherical. If desired, such pellets can be tumbled or otherwise finished to smooth the outer curvature.

According to a further aspect, the auto-segmenting spherical projectiles can be made by various powder metallurgy processes. For example, powder metallurgy processes include but are not limited to cold compaction processes, press and sinter (both solid-state and liquid-phase) processes, and metal injection molding processes. In addition, any of these powder metallurgy processes may optionally be followed by subsequent working of the article, such as by forging, extrusion, swaging, grinding, annealing, and/or sintering or other heat treatment. Moreover, composite materials can be made in this fashion and can include composites containing ceramics, polymers, and glasses, as well as metals. If desired, prior to placing the composition used to prepare the spherical projectile into a die or other mold, the die or mold may be lubricated to facilitate easier removal of the compacted article.

The process of fabricating the projectiles of this disclosure can include the formation of an intermediate structure, which can be reshaped if desired or further processed by a subsequent treatment. For example, the fabrication process can be carried out with or without heating the intermediate structure. Additionally or alternatively, the intermediate structure may be heated, including heating to the point of annealing and/or sintering. Although typically occurring after a compression step, one or more types of heating of an intermediate structure and/or article may occur at one or more stages during the formation process, including before, during and/or after the compression step. It also should be understood that heating is not required in some embodiments, and that articles may be produced according to the present invention without requiring the composition of matter to be heated. Typically, frangible projectiles are not sintered, but they may (or may not) be heated or annealed. Sintering may be either solid-phase sintering, in which the article is heated to near the melting point of the lowest melting component, or liquid-phase sintering, in which the article is heated to or above the melting point of the lowest melting component.

In one aspect, the auto-segmenting projectiles of this disclosure can comprise either frangible or non-frangible materials used to fabricate the projectile. A distinction is made between auto-segmenting behavior versus frangible behavior. A projectile made of non-frangible materials may auto-segment into the number of segments comprising the projectile, upon impacting a soft tissue or most other targets, but otherwise the individual segments may not generally break apart. A projectile made of frangible materials may auto-segment into the number of segments comprising the projectile upon impacting soft tissue, but otherwise break apart into countless irregular-shaped particles resembling dust upon striking a hard target, thereby preventing over-penetration. For example, a steel-copper composite projectile according to this disclosure can be fabricated into a frangible structure, which will break apart upon impacting soft tissue, but otherwise shatter into a powder when impacting a hard surface.

Applications of such projectiles made of frangible materials include buckshot for law enforcement, military, or self-defense use, where auto-segmenting technology combined with frangibility would lower the risk of richochet and/or collateral damage (for example, from over-penetration). However, when impacting tissue, the frangibility of the projectile does not manifest itself but auto-segmenting does. Therefore, such projectiles can penetrate clothing and tissue and auto-segment, thereby providing improved terminal performance of the buckshot. Such projectiles can be fabricated using non-toxic metals and materials, if desired. In one aspect, the frangible material can have a density lower than lead, and still afford excellent stopping power due to depositing its kinetic energy within target upon auto-segmenting. The compacted powdered metal method of making spherical projectiles (pellets) works well for these projectiles, particularly for fabricating non-toxic and/or frangible pellets.

Depending upon several factors, the auto-segmenting process can include a complete separation of the segments from every other segment (or most of the other segments) in the projectile, or alternatively, can include an opening up of the projectile, for example, in the clamshell projectile of FIGS. 1A-1D, without breaking the projectile completely apart at the connector or hinge. Such behavior may prove useful in, for example, limiting penetration in soft tissue when such behavior is desired. Projectile features such as the material used to fabricate the projectile, the thickness or shape of the connector (such as in FIGS. 1A-1D and FIGS. 2A-2E embodiments) and/or the depth of the cuts (such as in the FIG. 5 and FIG. 6 embodiments) can be adjusted to tailor the extent of separation of the segments. For example, a copper projectile fabricated with a clamshell structure such as in FIGS. 1A-1D, but with a large hinge, may merely open but not break apart the clamshell upon impacting soft tissue. By describing the connector as "separably connecting" the individual segments of the auto-segmenting sphere, it is intended to include the auto-segmenting process in which complete separation of the segments from the every other segment, partial separation of the segments from some other segments, or no separation but an "opening up" and expansion of the size of the projectile occur.

The auto-segmenting projectiles can be fabricated with a small number of similarly-sized and similarly-shaped sections, for example, 2, 3, 4, 5, 6, 7, 8, 9, 10, 11, 12, or more portions, and generally break into these number of segments upon impact. Typically, the auto-segmenting projectiles can be fabricated with, and generally separate into, 2, 3, 4, 5, 6, 7, or 8 portions. More typically, the auto-segmenting projectiles can be fabricated with, and generally separate into, 2, 4, or 8 portions, each usually but not necessarily identical in size and shape. In contrast, a conventional frangible projectile is designed to disintegrate into tiny particles upon impact, specifically to minimize the particles' penetration. Controlled penetration is desired and achieved for the auto-segmenting projectiles.

According to one aspect, the segments of the spherical projectile according to the disclosure can be identically-shaped, such as presented in the figures. However, identically-shaped projectiles are not required, and some segments of the spherical projectile according to the disclosure can be non-identically-shaped. For example, non-identically-shaped segments of the spherical projectile could be formed and connected using a connecting element according to this disclosure. A further aspect, the segments can be assembled into a sphere in a symmetric fashion. In another example, non-identically-shaped segments of the spherical projectile could be created by forming two or more identical segments, followed by further dividing each segment into an unequal shaped or sized sub-segment. Again, generally these non-identically-shaped segments are assembled into a sphere in a symmetric fashion.

As a review of the figures illustrates, there are several variables in the design of the projectiles that can be adjusted to attain the desired level of ease of separation and performance with each of the particular variables providing a high level of control in building in the desired performance to the projectile. By way of example, the size, shape, diameter (thickness), number, width, and composition of the connector(s) (sometimes referred to as "segment-connector" or "connecting element" or similar terms) that separably connects the individual segments can be adjusted to allow rapid or slower separation of the segments, which can alter the depth of penetration at which complete separation occurs. Thus, the connector element size, shape, diameter (thickness), number, width, and composition are design adjustable aspects that affect the ability of the spherical projectile to hold together and maintain its spherical integrity during the shotshell loading process, during cartridge firing, during flight, and until impact occurs. This ability to maintain its spherical integrity until impact is referred to as the segments being "separably connected". Generally, the overall spherical shape is retained when the segments are connected, and the connector features typically will not alter this aspect substantially.

In addition, these size, shape, diameter, and width features of the connecting element also allow adjusting the space or clearance between adjacent segments as needed. Some embodiments include a connect that is post-shaped, but the use of the term "post" to generally describe the connector does not necessarily limit the shape of the connector to a post- or column-shape unless the context requires otherwise. Generally, the connector or "post" will be shaped according to the fabrication method. When the segments are fabricated by cutting a sphere comprising a soft metal versus a powder metallurgy method using a spherical mold having ridges to impart cuts or grooves in the sphere, the shape of the connector may be substantially different.

Further, the exact location of the connecting element that separably connects the individual segments can be adjusted. Again, this aspect allows for controlling the rapid or slower separation of the segments and allows segments to be separated in series (in sequence) or simultaneously, which can alter the performance and depth at which the final and complete separation occurs. The figures generally demonstrate "end members" of a continuum of connecting element locations. That is, the connector can be situated at or near an edge of each section, at or near the center (or center of an edge) of each section, or anywhere in between these two positions. Adjusting connector location allows fine-tuning of performance Because more than one connector is an envisioned aspect, adjusting connector location and number further affords an ability to fine-tune performance.

The segments themselves are not required to be perfect hemispheres or quadraspheres and the like as illustrated in the figures. For example, and while not intending to be bound by theory, small to medium sized chamfers or bevels can be added along an edge where the segments meet. Such chamfers are thought to better allow the hydrostatic pressure of the contacting soft tissue or fluid to enter the space between the segments and initiate the auto-segmentation process. Any size, shape, number, and spacing of chamfers can be employed, each of which permits careful tailoring of auto-segmentation performance. Other features such as dimples or small holes envisioned along the "lines of separation" to allow better collection and focusing of hydrostatic pressure, to allow the segments to be wedged apart upon contact. For all these features, the number, depth, width, and overall size can be adjusted for the desired separating effect.

The composition of the connecting element that separably connects the individual segments also can be adjusted to allow control over the separation of the segments, and to provide additional embodiments that are more easily fabricated than others. The composition of the connector can be the same metal as the projectile, a different metal, a composite material, a polymeric material, a thermoplastic material, a thermoset material, an adhesive material, and the like. Moreover, a single shotshell load could contain projectiles of the same or different sizes that can be connected with connecting elements having different compositions.

The material from which the projectile itself is fabricated can vary considerably. For example, in accordance with another aspect, the auto-segmenting projectile can comprise lead or be lead-containing, or the projectile can be lead-free. Alternatively, the entire projectile can be non-metallic. For example, in some aspects and embodiments, the projectile can comprise lead, steel, bismuth, tungsten, tin, iron, copper, zinc, aluminum, nickel, chromium, molybdenum, cobalt, manganese, antimony, alloys thereof, composites thereof, or any combinations thereof.

The auto-segmenting spherical projectiles can be any size. For example, the spherical projectiles can be sized according to birdshot, buckshot, spherical slugs, or any single ball spherical projectile such as a slug or muzzle loading projectile or close-to-bore diameter projectile. The auto-segmenting spherical projectiles can be sized, for example, according to lead or steel shot sizes. Table 1 presented below reproduces standard shot sizes as a non-limiting illustration of this aspect, and any of the sizes shown and sizes not presented in this table can be prepared as described in this disclosure. Thus, even single spherical slugs can be used according to this disclosure that are sized for the particular firearm, for example a muzzle loaded firearm.

Table 1. Standard Shot Sizes

| Lead shot sizes: Pellet diameter | 12 | 9 | 8½ | 8 | 7½ | 6 | 5 | 4 | 2 | BB |
|---|---|---|---|---|---|---|---|---|---|---|
| (inches) | .05 | .080 | .085 | .090 | .095 | .110 | .120 | .130 | .150 | .180 |
| (mm) | 1.27 | 2.30 | 2.16 | 2.29 | 2.41 | 2.79 | 3.05 | 3.30 | 3.81 | 4.57 |

| Buckshot sizes: Pellet diameter | No. 4 | No. 3 | No. 2 | No. 1 | No. 0 | No. 00 | No. 000 |
|---|---|---|---|---|---|---|---|
| (inches) | .24 | .25 | .27 | .30 | .32 | .33 | .36 |
| (mm) | 6.10 | 6.35 | 6.86 | 7.62 | 8.13 | 8.38 | 9.14 |

| Steel shot sizes: Pellet diameter | 6 | 5 | 4 | 3 | 2 | 1 | Air Rifle | BB | BBB | T | F |
|---|---|---|---|---|---|---|---|---|---|---|---|
| (in.) | .11 | .12 | .13 | .14 | .15 | .16 | .177 | .18 | .19 | .20 | .22 |
| (mm) | 2.79 | 3.05 | 3.30 | 3.56 | 3.81 | 4.06 | 4.49 | 4.57 | 4.83 | 5.08 | 5.59 |

Note: the size of shot, whether lead or steel, is based on American Standard shot sizes.
Thus: a steel No. 4 pellet and a lead No. 4 pellet are both .13 inches (3.3 mm) in diameter.

The spherical projectiles of this disclosure can be fabricated by any method known in the art. In an aspect, for example, the projectiles can be fabricated from a solid spherical ball by cutting into but not through the solid spherical ball according to the desired segment pattern to create the segments and create the post or connecting element that connects the segments. This method of cutting around the post or connector can be applied to situate the connector at any desired location and having any desires shape. In other aspects, the projectiles of this disclosure can be fabricated from pre-formed segments that will form the solid spherical ball by introducing a connecting element made of the same metal as the projectile segments, a different metal, a composite material, a polymeric material, a thermoplastic material, and the like, for example by softening these materials so that they can be situated or placed in the desired location and made to contact each segment. Alternatively, an adhesive material can be used to create the post or connecting element, either alone or in combination with any of the aforementioned materials. In other aspects the post or connecting element can be prepared in situ using a thermoset material to contact the segments or by heating and softening the segments themselves and contacting them to form the connecting element at the contact point or contact area. Other aspects provide for separately creating segments having any desired chamfers or other features as disclosed and depositing softened or liquefied metal at the desired connector location on one segment, followed by contacting the softened connector metal by the other segment or segments.

As described in this disclosure, the various projectile aspects and features allow for tailoring the shot for the rate of opening, the penetration projectile, the number of segments desired, and generally adjusting the shot for its intended target, whether for deer or waterfowl hunting or for military, law enforcement, or personal defense use.

Again while not intending to be bound by theory, it is observed that the disclosed projectiles are capable of consuming a minimal amount of energy to cause segmenting upon impart. This feature may be particularly applicable to lower density materials, which do not have sufficient terminal velocity (retained speed) or energy upon impact to be particularly effective. Using the auto-segmenting design in spherical projectiles made of lower density materials such as steel provides a much greater energy deposit into the target than any conventional design. While not theory-bound, it is thought that the present design greatly improves the transmission of "dumping" of energy from the projectile to the living tissue. Once segmented, multiple wound channels are generated, and a greatly enlarged hydrostatic pressure wave zone is generated when the multiple segments diverge in the tissue. Moreover, segmentation or "auto-segmentation" is achieved regardless of the orientation of the projectile at impact. Therefore, it is thought that projectiles of low density generally that are typically required for waterfowl loads may benefit greatly from the present design by having much greater killing power than convention low density projectiles, because of the low energy requirement to induce segmenting but the greater energy deposit from multiple segments.

It is also thought that the chamfered edges when included in the projectiles function as pressure-collecting or pressure-concentrating features. That is, the recessed or dimpled structure along the edges as disclosed herein can help ensure that controlled opening of the segmented projectile occurs regardless of the orientation of the segmented projectile and therefore regardless of which leading edge of the spherical projectile strikes the target first.

This disclosure also provides for shotshells comprising any of the projectiles disclosed herein. Supporting aspects of this disclosure are found, for example, in the following publications, each of which is incorporated herein by reference in its entirety: Thomas J. Griffin, ed., *Shotshell Reloading Handbook,* $5^{th}$ ed., Lyman Publications, Lyman Products Corporation, Middletown, Conn. (2007); Don Zutz, *Hodgdon Powder Company Shotshell Data Manual,* $1^{st}$ ed., Hodgden Power Company, Shawnee Mission, Kans. (1996); Bob Brister, Shotgunning: The Art and the Science, Winchester Press, New Win Publishing, Inc., Clinton, N.J. (1976); and U.S. Patent Application Publication Number 2011/0017090. Thus, shotshell cartridges according to this disclosure can employ standard shotshell components and loading methods for their construction. By way of example, the shotshell cases or hulls, primers, propellant or powder, shot or other projectiles such as slugs, gas seals, and the like, have all been described in abundant detail in these cited references.

Throughout this specification, various publications may be referenced. The disclosures of these publications are hereby incorporated by reference in pertinent part, in order to more fully describe the state of the art to which the disclosed subject matter pertains. The references disclosed are also individually and specifically incorporated by reference herein for the material contained in them that is discussed in the sentence in which the reference is relied upon. To the extent that any definition or usage provided by any document incorporated herein by reference conflicts with the definition or usage provided herein, the definition or usage provided herein controls.

As used in the specification and the appended claims, the singular forms "a," "an," and "the" include plural referents, unless the context clearly dictates otherwise. Thus, for example, reference to "a projectile" includes a single projectile such as a slug, as well as any combination of more than one projectile, such as multiple pellets of shot of any size or combination of sizes. Also for example, reference to "a projectile" includes a single shot pellet having the features disclosed herein, or multiple shot pellets according to this disclosure, such as would be found, for example, in a loaded shotshell incorporating such pellets or projectiles.

Throughout the specification and claims, the word "comprise" and variations of the word, such as "comprising" and "comprises," means "including but not limited to," and is not intended to exclude, for example, other additives, components, elements, or steps. While compositions and methods are described in terms of "comprising" various components or steps, the compositions and methods can also "consist essentially of" or "consist of" the various components or steps.

"Optional" or "optionally" means that the subsequently described element, component, step, or circumstance can or cannot occur, and that the description includes instances where the element, component, step, or circumstance occurs and instances where it does not.

Unless indicated otherwise, when a range of any type is disclosed or claimed, for example a range of the particle sizes, percentages, temperatures, and the like, it is intended to disclose or claim individually each possible number that such a range could reasonably encompass, including any sub-ranges or combinations of sub-ranges encompassed therein. When describing a range of measurements such as sizes or weight percentages, every possible number that such a range could reasonably encompass can, for example, refer to values within the range with one significant figure more than is present in the end points of a range, or refer to values within the range with the same number of significant figures as the end point with the most significant figures, as the context indicates or permits. For example, when describing a range of percentage numbers such as from 85% to 95%, it is understood that this disclosure is intended to encompass each of 85%, 86%, 87%, 88%, 89%, 90%, 91%, 92%, 93%, 94%, and 95%, as well as any ranges, sub-ranges, and combinations of sub-ranges encompassed therein. Applicants' intent is that these two methods of describing the range are interchangeable. Accordingly, Applicants reserve the right to proviso out or exclude any individual members of any such group, including any sub-ranges or combinations of sub-ranges within the group, if for any reason Applicants choose to claim less than the full measure of the disclosure, for example, to account for a reference that Applicants are unaware of at the time of the filing of the application.

Values or ranges may be expressed herein as "about", from "about" one particular value, and/or to "about" another particular value. When such values or ranges are expressed, other embodiments disclosed include the specific value recited, from the one particular value, and/or to the other particular value. Similarly, when values are expressed as approximations, by use of the antecedent "about," it will be understood that the particular value forms another embodiment. It will be further understood that there are a number of values disclosed herein, and that each value is also herein disclosed as "about" that particular value in addition to the value itself.

In any application before the United States Patent and Trademark Office, the Abstract of this application is provided for the purpose of satisfying the requirements of 37 C.F.R. § 1.72 and the purpose stated in 37 C.F.R. § 1.72(b) "to enable the United States Patent and Trademark Office and the public generally to determine quickly from a cursory inspection the nature and gist of the technical disclosure." Therefore, the Abstract of this application is not intended to be used to construe the scope of the claims or to limit the scope of the subject matter that is disclosed herein. Moreover, any headings that are employed herein are also not intended to be used to construe the scope of the claims or to limit the scope of the subject matter that is disclosed herein. Any use of the past tense to describe an example otherwise indicated as constructive or prophetic is not intended to reflect that the constructive or prophetic example has actually been carried out.

Those skilled in the art will readily appreciate that many modifications are possible in the exemplary embodiments disclosed herein without materially departing from the novel teachings and advantages according to this disclosure. Accordingly, all such modifications and equivalents are intended to be included within the scope of this disclosure as defined in the following claims. Therefore, it is to be understood that resort can be had to various other aspects, embodiments, modifications, and equivalents thereof which, after reading the description herein, may suggest themselves to one of ordinary skill in the art without departing from the spirit of the present disclosure or the scope of the appended claims.

I claim:

1. An auto-segmenting spherical projectile, the projectile comprising: a) two solid hemispherical segments, each comprising a solid circular face oriented toward the center of the spherical projectile, a circular edge, and an uninterrupted hemispherical surface; and b) a connecting element having a thickness solidly attached between the centers of each solid circular face, wherein the two hemispherical segments and the connecting element are monolithic, wherein the thickness of the connecting element is less than the diameter of each solid circular face; and wherein the solid circular faces are spaced apart by the connecting element.

2. An auto-segmenting spherical projectile according to claim 1, wherein the thickness of the connecting element is less than the distance from the circular edge of each hemispherical segment to the connecting element.

3. An auto-segmenting spherical projectile according to claim 1, wherein the thickness of the connecting element is greater than or equal to the distance from the circular edge of each hemispherical segment to the connecting element.

4. An auto-segmenting spherical projectile according to claim 1, wherein the composition of the connecting element is the same as the composition of the hemispherical segments.

5. An auto-segmenting spherical projectile according to claim 1, wherein the composition of the connecting element is the different from the composition of the hemispherical segments.

6. An auto-segmenting spherical projectile according to claim 1, wherein the spherical projectile comprises birdshot, buckshot, or spherical slugs.

7. An auto-segmenting spherical projectile according to claim 1, wherein the spherical projectile comprises a frangible material.

8. An auto-segmenting spherical projectile according to claim 1, wherein the spherical projectile comprises a non-frangible material.

9. An auto-segmenting spherical projectile according to claim 1, wherein the spherical projectile comprises lead, steel, bismuth, tungsten, tin, iron, copper, zinc, aluminum, nickel, chromium, molybdenum, cobalt, manganese, antimony, alloys thereof, or composites thereof.

10. An auto-segmenting spherical projectile according to claim 1, wherein the spherical projectile is lead-free.

11. An auto-segmenting spherical projectile according to claim 1, wherein the circular edge of each hemispherical segment is chamfered.

12. An auto-segmenting spherical projectile according to claim 1, wherein the projectile is prepared by a compacted powder process.

13. A cartridge comprising at least one auto-segmenting spherical projectile according to claim 1.

14. An auto-segmenting spherical projectile according to claim 1, wherein the connecting element is column-shaped.

* * * * *